US010480519B2

(12) United States Patent
Bryan

(10) Patent No.: US 10,480,519 B2
(45) Date of Patent: Nov. 19, 2019

(54) HYBRID COMPRESSOR

(71) Applicant: Rolls-Royce North American Technologies, Inc., Indianapolis, IN (US)

(72) Inventor: William B. Bryan, Indianapolis, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 796 days.

(21) Appl. No.: 15/081,419

(22) Filed: Mar. 25, 2016

(65) Prior Publication Data

US 2016/0290342 A1 Oct. 6, 2016

Related U.S. Application Data

(60) Provisional application No. 62/140,904, filed on Mar. 31, 2015.

(51) Int. Cl.

| | |
|---|---|
| ***F04D 19/02*** | (2006.01) |
| ***F04D 17/02*** | (2006.01) |
| ***F01D 5/04*** | (2006.01) |
| ***F01D 9/04*** | (2006.01) |

(52) U.S. Cl.

CPC ..... *F04D 19/028* (2013.01); *F01D 5/045* (2013.01); *F01D 5/048* (2013.01); *F01D 9/041* (2013.01); *F04D 17/025* (2013.01); *F05D 2220/40* (2013.01)

(58) Field of Classification Search

CPC .... F04D 19/028; F04D 17/025; F04D 29/284; F01D 5/045; F01D 5/048; F01D 5/142; F02C 3/08

See application file for complete search history.

(56) References Cited

U.S. PATENT DOCUMENTS

| | | | | | |
|---|---|---|---|---|---|
| 3,357,176 | A * | 12/1967 | Williams | F02C 3/08 | 60/792 |
| 3,941,499 | A * | 3/1976 | Kronogard | F01D 25/002 | 415/116 |
| 4,428,715 | A | 1/1984 | Wiggins | | |
| 4,678,398 | A * | 7/1987 | Dodge | F04D 29/544 | 415/181 |
| 4,981,018 | A * | 1/1991 | Jones | F02C 3/08 | 415/143 |
| 5,564,898 | A | 10/1996 | Richards | | |
| 5,961,282 | A | 10/1999 | Wittrisch | | |
| 6,488,469 | B1 | 12/2002 | Youssef | | |
| 6,499,953 | B1 | 12/2002 | Bellerose | | |
| 8,231,341 | B2 * | 7/2012 | Anderson | F02C 3/08 | 415/181 |
| 2010/0232953 | A1 * | 9/2010 | Anderson | F02C 3/08 | 415/199.2 |

(Continued)

*Primary Examiner* — Eldon T Brockman

(74) *Attorney, Agent, or Firm* — Barnes & Thornburg LLP

(57) ABSTRACT

A compressor for a gas turbine engine is disclosed. The compressor includes a first compression stage mounted for rotation about a central axis that includes a plurality of first-stage blades. The compressor also includes a second compression stage mounted along the central axis aft of the first compression stage to receive air compressed by the first compression stage. The second compression stage includes a plurality of second-stage blades.

17 Claims, 1 Drawing Sheet

*FIG. 1*

(56) References Cited

U.S. PATENT DOCUMENTS

2013/0121804 A1* 5/2013 Oliphant ..... F01D 5/141
415/1
2014/0271173 A1* 9/2014 Bryan ..... F04D 29/441
415/211.2

* cited by examiner

HYBRID COMPRESSOR

CROSS REFERENCE TO RELATED APPLICATIONS

This application claims priority to and the benefit of U.S. Provisional Patent Application No. 62/140,904, filed 31 Mar. 2015, the disclosure of which is now expressly incorporated herein by reference.

FIELD OF THE DISCLOSURE

The present disclosure relates generally to gas turbine engines, and more specifically to compressors of gas turbine engines.

BACKGROUND

Gas turbine engines typically include a compressor, a combustor, and a turbine. The compressor compresses air drawn into the engine and delivers high pressure air to the combustor. In the combustor, fuel is mixed with the high pressure air and the air/fuel mixture is ignited. Products of the combustion reaction in the combustor are directed into the turbine where work is extracted to drive various components of the gas turbine engine, such as the compressor.

Gas turbine engines typically include an axial compressor and/or a centrifugal compressor. An axial compressor typically has alternating stages of static vane assemblies and rotating wheel assemblies that compress air moved along a central axis. A centrifugal compressor typically includes a single rotor that is shaped to compress and discharge air in radial direction away from a central axis. Improving gas turbine engine performance by providing alternatives to conventional axial and centrifugal compressors remains an area of interest.

SUMMARY

The present disclosure may comprise one or more of the following features and combinations thereof.

According to one aspect of the present disclosure, a compressor for a gas turbine engine may comprise a first compression stage and a second compression stage. The first compression stage may be mounted for rotation about a central axis, and the first compression stage may include a plurality of first-stage blades. The second compression stage may be mounted along the central axis aft of the first compression stage to receive air compressed by the first compression stage. The second compression stage may include a plurality of second-stage blades, and the second compression stage may be shaped to conduct air in a substantially radial direction away from the central axis and to discharge air in an axial direction parallel to the central axis.

In some embodiments, the average exit radius of the plurality of second-stage blades may be greater than the inlet tip radius radius of the plurality of second-stage blades. Additionally, in some embodiments, the average exit radius of the plurality of first-stage blades may be greater than the inlet tip radius of the plurality of first-stage blades.

In some embodiments, the first compression stage may be supported by a first shaft extending along the central axis, and the second compression stage may be supported by a second shaft separate from the first shaft extending along the central axis.

In some embodiments, the compressor may further comprise a diffuser mounted aft of an outlet of the second compression stage along the central axis and shaped to conduct air in substantially only the axial direction parallel to the central axis. The diffuser may include a first outlet guide vane aligned with the outlet of the second compression stage in the axial direction to receive air discharged in the axial direction parallel to the central axis by the outlet and to conduct air from the outlet in only the axial direction parallel to the central axis.

In some embodiments, the diffuser may further include a second outlet guide vane aligned with the first outlet guide vane in the axial direction to receive air discharged in the axial direction parallel to the central axis by the first outlet guide vane and to conduct air from the first outlet guide vane in only the axial direction parallel to the central axis. The second outlet guide vane may be spaced from the first outlet guide vane in the axial direction without a rotating component being positioned between the first and second outlet guide vanes.

In some embodiments, the compressor may further comprise an interstage vane mounted between the first compression stage and the second compression stage along the central axis, and the interstage vane may be shaped to redirect air exiting the first compression stage in the axial and radial directions before the air enters the second compression stage.

According to another aspect of the present disclosure, a compressor for a gas turbine engine may comprise a first compression stage and a second compression stage. The first compression stage may be mounted for rotation about a central axis, and the first compression stage may include a plurality of first-stage blades. The second compression stage may be mounted along the central axis aft of the first compression stage, and the second compression stage may include a plurality of second-stage blades. The second-stage blades may each have an inlet portion that has an inlet hub radius and an inlet tip radius, an outlet portion shaped to discharge air in an axial direction parallel to the central axis that has an outlet hub radius and an outlet tip radius, and an average exit radius substantially midway between the outlet hub radius and the outlet tip radius that is greater than the inlet tip radius.

In some embodiments, each of the plurality of second-stage blades may include a radial-compression portion shaped to conduct air in a substantially radial direction away from the central axis. Additionally, in some embodiments, the inlet tip radius of the inlet portions of the second-stage blades may be less than the average exit radius of the outlet portions of the second-stage blades.

In some embodiments, the compressor may further comprise a diffuser mounted aft of the outlet portions of the second compression stage along the central axis and shaped to conduct air in substantially only the axial direction parallel to the central axis. The diffuser may include a first outlet guide vane aligned with the outlet portions of the second-stage blades in the axial direction to receive air discharged in the axial direction parallel to the central axis and to conduct air from the outlet portions in substantially only the axial direction parallel to the central axis.

In some embodiments, the diffuser may include a first outlet guide vane aligned with the outlet portions of the second-stage blades in the axial direction to receive air discharged from the second compression stage and to conduct air from the outlet portions in substantially only the axial direction parallel to the central axis, and a second outlet guide vane aligned with the first outlet guide vane in the axial direction to receive air discharged in the axial direction from the first outlet guide vane and to conduct air from the first outlet guide vane in substantially only the axial direction parallel to the central axis. The second outlet guide vane may be spaced from the first outlet guide vane in the axial direction without a rotating component being positioned between the first and second outlet guide vanes.

In some embodiments, the compressor may further comprise an interstage vane mounted between the first compression stage and the second compression stage along the central axis, and the interstage vane may be shaped to redirect air exiting the first compression stage in the axial and radial directions toward the second compression stage.

In some embodiments, the first compression stage may be supported by a first shaft extending along the central axis, and the second compression stage may be supported by a second shaft separate from the first shaft extending along the central axis.

These and other features of the present disclosure will become more apparent from the following description of the illustrative embodiments.

DETAILED DESCRIPTION OF THE DRAWINGS

Figure 1:
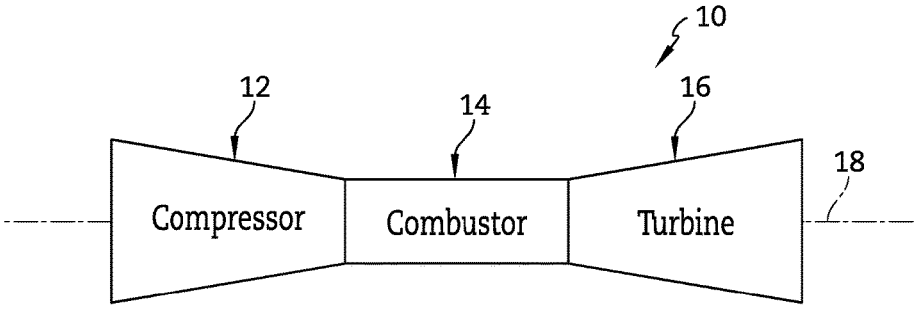
FIG. 1 is a diagrammatic view of a gas turbine engine.

For the purposes of promoting an understanding of the principles of the disclosure, reference will now be made to a number of illustrative embodiments illustrated in the drawings and specific language will be used to describe the same.

Referring now to FIG. 1, a diagrammatic view of an illustrative gas turbine engine 10 is shown. The gas turbine engine 10 includes a compressor 12, a combustor 14, and a turbine 16. The compressor 12 compresses and delivers air to the combustor 14. The combustor 14 mixes the compressed air with fuel, ignites the air/fuel mixture, and delivers the combustion products (i.e., hot, high-pressure gases) to the turbine 16. The turbine 16 converts the combustion products to mechanical energy (i.e., rotational power) that drives the compressor 12. The turbine 16 may also be coupled to a fan, a propeller, a gearbox, a pump, or the like to drive such accessories. The compressor 12, the combustor 14, and the turbine 16 are illustratively arranged along a central axis 18 of the gas turbine engine 10.

Figure 2:
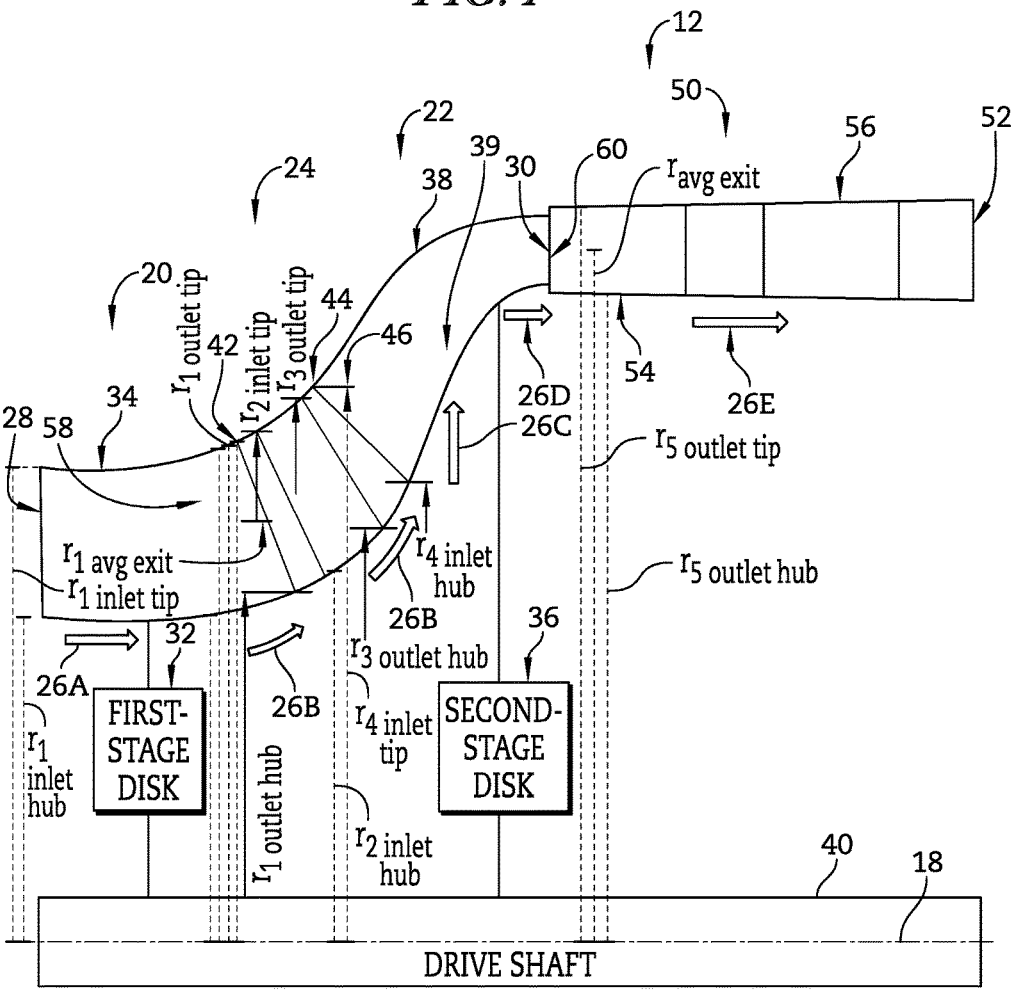
FIG. 2 is a partially-diagrammatic cross-sectional view of a compressor included in the gas turbine engine of FIG. 1.

Referring now to FIG. 2, the compressor 12 is shown in detail. The compressor 12 illustratively includes a first rotor stage 20, a second rotor stage 22, an inter-stage vane 24, and a diffuser 50. The first and second rotor stages 20, 22 are referred to herein as the forward and aft compression stages 20, 22, respectively. The inter-stage vane 24 is mounted aft of the forward compression stage 20 along the central axis 18. The aft compression stage 22 is mounted aft of the inter-stage vane along the central axis 18. The diffuser 50 is mounted aft of the aft compression stage 22 along the central axis 18.

The forward compression stage 20 is adapted to compress and conduct air in substantially the axial direction (i.e., the direction parallel to the axis 18) from a forward compression stage inlet 28 toward a forward compression stage outlet 58 as suggested by arrow 26A in FIG. 2. At the forward compression stage outlet 58, compressed air is conducted in the axial and radial directions as suggested by arrow 26B to the inter-stage vane 24. The inter-stage vane 24 redirects compressed air from the forward compression stage 20 as suggested by arrow 26B before the compressed air enters the aft compression stage 22. The aft compression stage 22 is adapted to further compress air exiting the inter-stage vane 24 while the air moves in substantially the radial direction as suggested by arrow 26C. The aft compression stage 22 is also adapted to discharge the compressed air in substantially the axial direction as suggested by arrow 26D to the diffuser 50. The diffuser 50 is adapted to conduct compressed air from the aft compression stage 22 in substantially only the axial direction as suggested by arrow 26E to the combustor 14.

The forward compression stage 20 illustratively includes a forward compression stage inlet 28, a forward compression stage outlet 58, a disk 32, and a plurality of blades 34 coupled to the disk 32 as shown in FIG. 2. The disk 32 and the blades 34 are referred to herein as the first-stage disk 32 and the first-stage blades 34, respectively. The first-stage disk 32 and the first-stage blades 34 are mounted for rotation about the axis 18 to conduct and compress air received at the forward stage inlet 28 to the forward stage outlet 58. The first-stage blades 34 are shaped to conduct air from the forward stage inlet 28 toward the forward stage outlet 58 in substantially the axial direction as suggested by arrow 26A. At the forward stage outlet 58, the first-stage blades 34 are shaped to conduct air in the axial and radial directions to the inter-stage vane 24 as suggested by arrow 26B.

The first-stage disk 32 and the first-stage blades 34 of the forward compression stage 20 are illustratively mounted on a drive shaft 40 as shown in FIG. 2. The drive shaft 40 extends along the central axis 18. The drive shaft 40 is coupled to the turbine 16 and is adapted to be driven by the turbine 16 to rotate about the axis 18. The first-stage disk 32 and the first-stage blades 34 are adapted to rotate with the drive shaft 40 about the axis 18.

The first-stage blades 34 of the forward compression stage 20 have a variable radius measured relative to the central axis 18 between the forward stage inlet 28 and the forward stage outlet 58 as shown in FIG. 2. The first-stage blades 34 illustratively have an inlet hub radius $r_{1inlethub}$ and an inlet tip radius radius $r_{1inlettip}$ measured relative to the central axis 18 at the inlet 28 that is greater than the inlet hub radius $r_{1inlethub}$. The first-stage blades 34 have an outlet hub radius $r_{1outlethub}$ and an outlet tip radius $r_{1outlettip}$ measured relative to the central axis 18 at the outlet 58 that is greater than the outlet hub radius $r_{1outlethub}$. Additionally, the first-stage blades 34 have an average exit radius $r_{1avgexit}$ measured relative to the central axis 18. The average exit radius $r_{1avgexit}$ is illustratively greater than the inlet tip radius $r_{1inlettip}$ and the outlet hub radius $r_{1outlethub}$. The outlet tip radius $r_{1outlettip}$ is greater than the inlet tip radius $r_{1inlettip}$ and the average exit radius $r_{1avgexit}$.

The inter-stage vane 24 illustratively includes an inter-stage inlet 42 and an inter-stage outlet 44 as shown in FIG. 2. The inter-stage vane 24 is a stator element that is constrained against rotation about the central axis 18. The inter-stage vane 24 is shaped to redirect compressed air received at the inter-stage inlet 42 in the axial and radial directions as suggested by arrow 26B to the inter-stage outlet 44.

The inter-stage vane 24 illustratively has a variable radius measured relative to the axis 18 between the inter-stage inlet 42 and the inter-stage outlet 44 as shown in FIG. 2. The inter-stage vane 24 has an inlet tip radius $r_2$ measured relative to the axis 18 at the inter-stage inlet 42. The inter-stage vane 24 has an outlet tip radius $r_3$ measured relative to the axis 18 at the inter-stage outlet 44. The outlet tip radius $r_3$ is greater than the inlet tip radius $r_2$ as shown in FIG. 2.

The aft compression stage 22 illustratively includes an aft compression stage inlet 46, an aft compression stage outlet 30, a disk 36, and a plurality of blades 38 coupled to the disk 36 as shown in FIG. 2. The disk 36 and the blades 38 are referred to herein as the second-stage disk 36 and the second-stage blades 38, respectively. The second-stage disk 36 and the second-stage blades 38 are mounted for rotation about the axis 18 to compress and conduct compressed air received at the aft compression stage inlet 46 to the aft compression stage outlet 30. The second-stage blades 38 include a radial-compression portion 39 that is shaped to conduct compressed air from the aft stage inlet 46 in substantially the radial direction as suggested by arrow 26C toward the aft stage outlet 30. The second-stage blades 38 are shaped to discharge compressed air in substantially the axial direction as suggested by arrow 26D from the aft stage outlet 30 to the diffuser 50.

In some embodiments, the second-stage blades 38 may be shaped to discharge compressed air at the outlet 30 in a direction that is not parallel to the axis 18. In those embodiments, the blades 38 may be shaped to discharge compressed air at the outlet 30 at an angle relative to the axis 18. For example, due to interfacing with the combustor 14 or some other component of the engine 10, the blades 38 may be shaped to discharge compressed air at the outlet 30 at a finite, acute angle relative to the axis 18.

The second-stage disk 36 and the second-stage blades 38 of the aft compression stage 22 are illustratively mounted on the drive shaft 40 as shown in FIG. 2. Like the first-stage disk 32 and the first-stage blades 34, the second-stage disk 36 and the second-stage blades 38 are adapted to rotate with the drive shaft 40 about the axis 18.

The second-stage blades 38 of the aft compression stage 22 illustratively have a variable radius measured relative to the axis 18 between the aft stage inlet 46 and the aft stage outlet 30 as shown in FIG. 2. The second-stage blades 38 illustratively have an inlet hub radius $r_{4inlethub}$ and an inlet tip radius $r_{4inlettip}$ measured relative to the axis 18 at the aft stage inlet 46 that is greater than the inlet hub radius $r_{4inlethub}$. The second-stage blades 38 have an outlet hub radius $r_{5outlethub}$ and an outlet tip radius $r_{5outlettip}$ measured relative to the axis 18 at the aft stage outlet 30 that is greater than the outlet hub radius $r_{5outlethub}$. Additionally, the second-stage blades 38 have an average exit radius $r_{avgexit}$ measured relative to the axis 18 substantially midway between the outlet hub radius $r_{5outlethub}$ and the outlet tip radius $r_{5outlettip}$. The outlet tip radius $r_{5outlettip}$ is greater than the inlet tip radius $r_{4inlettip}$, and the average exit $r_{avgexit}$ is greater than the inlet tip radius $r_{4inlettip}$.

The average exit radius $r_{avgexit}$ of the second-stage blades 38 is greater than the inlet tip radius $r_{1inlettip}$, the outlet tip radius $r_{1outlettip}$, and the average exit radius $r_{1avgexit}$ of the first-stage blades 34 as shown in FIG. 2. The outlet tip radius $r_{5outlettip}$ of the second-stage blades 38 is greater than inlet tip radius $r_{1inlettip}$, the outlet tip radius $r_{1outlettip}$, and the average exit radius $r_{1avgexit}$ of the first-stage blades 34. The outlet tip radius $r_3$ of the inter-stage vane 24 is substantially equal to the inlet tip radius $r_{4inlettip}$ of the second-stage blades 38. The inlet tip radius $r_2$ of the inter-stage vane 24 is substantially equal to the outlet tip radius $r_{1outlettip}$ of the first-stage blades 34.

The diffuser 50 illustratively includes a diffuser inlet 60, a diffuser exit 52, a forward outlet guide vane 54, and an aft outlet guide vane 56 as shown in FIG. 2. The forward outlet guide vane 54 is mounted forward of the aft outlet guide vane 56 along the central axis 18. The forward and aft outlet guide vanes 54, 56 are constrained against rotation about the axis 18. The forward and aft outlet guide vanes 54, 56 are spaced from one another in the axial direction without a rotating component being positioned between the vanes 54, 56 as shown in FIG. 2.

The forward outlet guide vane 54 of the diffuser 50 is aligned with the aft stage outlet 30 in the axial direction to receive compressed air discharged from the outlet 30 in the axial direction at the diffuser inlet 60 as shown in FIG. 2. Additionally, the outlet guide vane 54 is aligned with the aft stage outlet 30 in the axial direction to conduct compressed air from the outlet 30 to the aft outlet guide vane 56 in substantially only the axial direction as suggested by arrow 26E. The aft outlet guide vane 56 is aligned with the forward outlet guide vane 54 in the axial direction to receive compressed air discharged from the vane 54 in the axial direction. Additionally, the aft outlet guide vane 56 is aligned with the outlet guide vane 54 in the axial direction to conduct compressed air from the vane 54 to the diffuser exit 52 in substantially only the axial direction as suggested by arrow 26E.

Referring now to FIGS. 1-2, operation of the compressor 12 in the engine 10 will be described. During operation of the compressor 12, air is first conducted to the forward stage inlet 28. The first-stage blades 34 are driven to rotate about the axis 18 to compress the air and conduct the compressed air in substantially the axial direction indicated by arrow 26A from the forward stage inlet 28 toward the forward stage outlet 58. The first-stage blades 34 are also driven to rotate about the axis 18 to compress the air and conduct the compressed air in the axial and radial directions indicated by arrow 26B at the forward stage outlet 58 to the inter-stage vane 24. Compressed air enters the inter-stage inlet 42 from the forward stage outlet 58 and is redirected in the axial and radial directions indicated by arrow 26B to the inter-stage outlet 44. Compressed air enters the aft stage inlet 46 from the inter-stage outlet 44. The second-stage blades 38 are driven to rotate about the axis 18 to further compress the compressed air received at the aft stage inlet 46, conduct the compressed air in substantially the radial direction indicated by arrow 26C toward the aft stage outlet 30, and discharge the compressed air in substantially the axial direction indicated by arrow 26D to the diffuser inlet 60. Compressed air received at the diffuser inlet 60 is conducted in substantially only the axial direction indicated by arrow 26E to the diffuser exit 52. Compressed air is then conducted to the combustor 14 from the diffuser exit 52.

Referring again to FIGS. 1-2, a method of operating the compressor 12 will be described. The method includes compressing air via the forward compression stage 20 so that compressed air is conducted in substantially the axial direction toward the aft compression stage 22. The method further includes further compressing the compressed air via the aft compression stage 20 so that compressed air is conducted in substantially the radial direction and discharged in substantially the axial direction to the diffuser 50. Additionally, the method may further still include redirecting the compressed air exiting the forward stage 20 in the axial and radial directions via the inter-stage vane 24 toward the aft stage 22 after compressing the air via the forward stage 20 and before further compressing the compressed air via the aft stage 22.

In some embodiments, in addition to the forward compression stage 20, the inter-stage vane 24, the aft compression stage 22, and the diffuser 50, the compressor 12 may include an inlet guide vane mounted along the central axis 18 forward of the forward compression stage 20. Like the inter-stage vane 24, the inlet guide vane may be a stator component that is constrained against rotation about the central axis 18.

In some embodiments, in addition to the compression stages 20, 22 and the inter-stage vane 24 positioned between the stages 20, 22, the compressor 12 may include a number of compression stages similar to the stages 20, 22. The additional compression stages may have one or more stator components similar to the inter-stage vane 24 positioned between the additional compression stages.

In some embodiments, in addition to the compression stages 20, 22, the compressor 12 may include one or more compression stages mounted forward of the forward compression stage 20 along the central axis 18. For example, the compressor 12 may include one or more axial compression stages mounted forward of the forward compression stage 20 along the axis 18.

In some embodiments, in addition to the forward and aft outlet guide vanes 54, 56, the diffuser 50 of the compressor 12 may include one or more additional outlet guide vanes. For example, the diffuser 50 may include a total of three or four outlet guide vanes. In other embodiments, however, the diffuser 50 may include only one of the forward and aft outlet guide vanes 54, 56.

In some embodiments, the drive shaft 40 may include multiple shafts that are separate from one another. For example, the drive shaft 40 may include a first-stage shaft and a second-stage shaft to accommodate rotation of the first-stage blades 34 and the second-stage blades 38 at different speeds. The first-stage shaft and the second-stage shaft may be separate from one another and coaxially aligned along the central axis 18. The first-stage shaft may support the first-stage disk 32 and the first-stage blades 34 about the axis 18, and the second-stage shaft may support the second-stage disk 36 and the second-stage blades 38 about the axis 18. In such embodiments, the drive shaft 40 may be coupled to the turbine 16 so that the drive shaft 40 may be adapted to be driven by the turbine 16 to rotate about the axis 18. As a result, the disks 32, 36 and the respective blades 34, 38 may be adapted to rotate with the respective first and second-stage shafts about the axis 18.

While the compressor 12 is described herein within the context of gas turbine engines such as the gas turbine engine 10, the compressor 12 may be used in other applications. For example, the compressor 12 may be adapted for use in turbochargers, superchargers, pumps, or other suitable applications.

The present disclosure provides a hybrid compressor that combines axial-like compressor blading laid out on an increasing flow path radius. The invention uses axial compressor-like blading but a centrifugal impeller-like flow path that has a substantially increasing radius. The impeller may have two or more rotor rows with one or more stators in between the rows and one or more stators at the exit. The exit may be an axial exit, rather than a radial exit as found in traditional centrifugal compressors. The exit may instead be a radial exit. Different rotors may be positioned on different shafts, or different rotors may be positioned on the same shaft.

Most gas turbine compressors are either of an axial or centrifugal design. An axial compressor typically has multiple stages (1 stage=1 rotor+1 stator) with only a slightly varying radius from inlet to exit. A centrifugal compressor typically has a single rotor with an axially oriented inlet but a purely radial exit with a radial diffuser, followed by a scroll or turning vane.

The present disclosure may provide an improvement in the form of an efficiency gain achieved through the increase in radius. A traditional compressor may produce wakes, separation and diffusion that may limit any efficiency gains. By using the axial compressor-like blading of the present invention, wakes, separation and diffusion may be managed to realize greater efficiency gains.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A compressor for a gas turbine engine, the compressor comprising a first compression stage mounted for rotation about a central axis, the first compression stage including a plurality of first-stage blades, and a second compression stage mounted for rotation along the central axis aft of the first compression stage to receive air compressed by the first compression stage, the second compression stage including a plurality of second-stage blades, the second compression stage shaped to conduct air in a substantially radial direction away from the central axis and to discharge air in a substantially axial direction parallel to the central axis, wherein an average exit radius of the plurality of first stage-blades is greater than an inlet tip radius of the plurality of first-stage blades.

2. The compressor of claim 1, wherein the average exit radius of the plurality of second-stage blades is greater than the inlet tip radius of the plurality of second stage-blades.

3. The compressor of claim 1, further comprising a diffuser mounted aft of an outlet of the second compression stage along the central axis, the diffuser shaped to conduct air in substantially only the axial direction parallel to the central axis.

4. The compressor of claim 3, wherein the diffuser comprises a first outlet guide vane aligned with the outlet of the second compression stage in the axial direction to receive air discharged in the axial direction parallel to the central axis by the outlet of the second compression stage and to conduct air from the outlet of the second compression stage in only the axial direction parallel to the central axis.

5. The compressor of claim 4, wherein the diffuser further comprises a second outlet guide vane aligned with the first outlet guide vane in the axial direction to receive air discharged in the axial direction parallel to the central axis by the first outlet guide vane and to conduct air from the first outlet guide vane in only the axial direction parallel to the central axis.

6. The compressor of claim 5, wherein the second outlet guide vane is spaced from the first outlet guide vane in the axial direction without a rotating component being positioned between the first and second outlet guide vanes.

7. The compressor of claim 1, further comprising an interstage vane mounted between the first compression stage and the second compression stage along the central axis, the interstage vane shaped to redirect air exiting the first compression stage in the axial and radial directions before the air enters the second compression stage.

8. The compressor of claim 1, wherein (i) the first compression stage is supported by a first shaft extending along the central axis and (ii) the second compression stage is supported by a second shaft separate from the first shaft extending along the central axis.

9. A compressor for a gas turbine engine, the compressor comprising a first compression stage mounted for rotation about a central axis, the first compression stage including a plurality of first-stage blades, wherein an average exit radius of the plurality of first stage-blades is greater than an inlet tip radius of the plurality of first-stage blades, and a second compression stage mounted for rotation along the central axis aft of the first compression stage, the second compression stage including a plurality of second-stage blades, the second-stage blades each having an inlet portion that has an inlet hub radius and an inlet tip radius, an outlet portion shaped to discharge air in a substantially axial direction parallel to the central axis that has an outlet hub radius and an outlet tip radius, and an average exit radius substantially midway between the outlet hub radius and the outlet tip radius that is greater than the inlet tip radius.

10. The compressor of claim 9, wherein each of the plurality of second-stage blades includes a radial-compression portion shaped to conduct air in a substantially radial direction away from the central axis.

11. The compressor of claim 9, wherein the inlet tip radius of the inlet portions of the second-stage blades is less than the average exit radius of the outlet portions of the second-stage blades.

12. The compressor of claim 11, further comprising a diffuser mounted aft of the outlet portions of the second compression stage along the central axis and shaped to conduct air in substantially only the axial direction parallel to the central axis.

13. The compressor of claim 12, wherein the diffuser comprises a first outlet guide vane aligned with the outlet portions of the second-stage blades in the axial direction to receive air discharged in the axial direction parallel to the central axis and to conduct air from the outlet portions in substantially only the axial direction parallel to the central axis.

14. The compressor of claim 12, wherein the diffuser comprises (i) a first outlet guide vane aligned with the outlet portions of the second-stage blades in the axial direction to receive air discharged from the second compression stage and to conduct air from the outlet portions in substantially only the axial direction parallel to the central axis, and (ii) a second outlet guide vane aligned with the first outlet guide vane in the axial direction to receive air discharged in the axial direction from the first outlet guide vane and to conduct air from the first outlet guide vane in substantially only the axial direction parallel to the central axis.

15. The compressor of claim 14, wherein the second outlet guide vane is spaced from the first outlet guide vane in the axial direction without a rotating component being positioned between the first and second outlet guide vanes.

16. The compressor of claim 12, further comprising an interstage vane mounted between the first compression stage and the second compression stage along the central axis, the interstage vane shaped to redirect air exiting the first compression stage in the axial and radial directions toward the second compression stage.

17. The compressor of claim 12, wherein (i) the first compression stage is supported by a first shaft extending along the central axis and (ii) the second compression stage is supported by a second shaft separate from the first shaft extending along the central axis.

* * * * *